United States Patent [19]

Jozefczak

[11] Patent Number: 4,692,960

[45] Date of Patent: Sep. 15, 1987

[54] CHECK AND CONTROL FOR A SLIDING DOOR

[75] Inventor: Thadius F. Jozefczak, Warren, Mich.

[73] Assignee: General Motors Corporation, Detroit, Mich.

[21] Appl. No.: 901,394

[22] Filed: Aug. 28, 1986

[51] Int. Cl.[4] ..... E05D 15/00; E05D 13/08

[52] U.S. Cl. ..... 16/86 A; 16/85; 16/86 B; 49/213; 188/268

[58] Field of Search ..... 16/85, 86 R, 86 A, 86 B, 16/337, 348, 360; 49/213; 188/268, 372

[56] References Cited

U.S. PATENT DOCUMENTS

| | | | |
|---|---|---|---|
| 1,221,751 | 4/1917 | Lane | 16/337 |
| 2,268,942 | 1/1942 | Jacobs | 16/85 |
| 2,476,182 | 7/1949 | Davidson | 16/86 C |
| 2,709,275 | 5/1955 | Johnson | 16/332 |
| 3,124,829 | 3/1964 | De Vito | 16/335 |
| 3,165,777 | 1/1965 | Peras | 16/85 |

*Primary Examiner*—Nicholas P. Godici
*Assistant Examiner*—Richard K. Seidel
*Attorney, Agent, or Firm*—Charles E. Leahy

[57] ABSTRACT

According to the invention a follower member is mounted on the door adjacent the door mounted roller and extends into the body mounted track further than the roller. A spring-like leaf is mounted in the track along at least a portion of the path of travel of the follower member along the track during the back and forth movement of the door. The leaf projects into the path of the follower member to interfere therewith so that the leaf is flexed and thereby impedes travel of the door along the track. A block of elastic material is mounted in a space between the track and the leaf to yieldably support the leaf against the flexure by the follower member during the back and forth movement of the door. The elasticity of the block of elastic material may vary along its length and determines the extent to which the movement of the door is impeded by the engagement of the follower member with the leaf.

4 Claims, 5 Drawing Figures

CHECK AND CONTROL FOR A SLIDING DOOR

The invention relates to a mechanism for checking and controlling the travel of a vehicle sliding door.

BACKGROUND OF THE INVENTION

It is well known in motor vehicles to provide an occupant compartment accessible through a door opening which is selectively opened and closed by a movably mounted door. The door may be mounted on hinges for pivotal movement between open and closed positions or the door may be mounted by a track and roller arrangement for sliding movement between the open and closed positions.

It is also known in motor vehicle doors to provide a mechanism which checks and controls the movement of the door, for example, to hold the door open at a fully opened position or a partially opened position. The present invention provides a new and improved check and control mechanism for a vehicle door of the sliding type.

In such a sliding door arrangement the track is usually mounted on the body and a roller is mounted on the door by a suitable bracket. The roller is preferably a roller assembly having at least one roller which establishes the vertical position of the door with respect to the door opening and at least one second roller which establishes the transverse position of the door with respect to the body opening.

SUMMARY OF THE INVENTION

According to the invention a follower member is mounted on the door adjacent the door mounted roller and extends into the body mounted track further than the roller. A spring-like leaf is mounted in the track along at least a portion of the path of travel of the follower member along the track during the back and forth movement of the door. The leaf projects into the path of the follower member to interfere therewith so that the leaf is flexed and thereby impedes travel of the door along the track. A block of elastic material is mounted in a space between the track and the leaf to yieldably support the leaf against the flexure by the follower member during the back and forth movement of the door. The elasticity of the block of elastic material may vary along its length and determines the extent to which the movement of the door is impeded by the engagement of the follower member with the leaf. Accordingly, the check and hold open mechanism may function to check the movement of the door at various points along its path of travel or hold the door at a desired position along the path of travel.

Accordingly, the object, feature and advantage of the invention resides in the provision of a follower member carried by the supporting roller of a sliding door and engageable with a leaf mounted in the track along the path of travel to yieldably impede the movement of the door along the track.

A further object, feature and advantage resides in the provision of a block of elastic material mounted in a space between a sliding door track and a spring-like resilient leaf mounted in the track and engageable by a follower member carried by a door mounted roller to engage with the leaf and elastically yield the elastic material to thereby impede the sliding movement of the door.

BRIEF DESCRIPTION OF THE DRAWINGS

These and other features, objects and advantages of the invention will become apparent upon consideration of the description of the preferred embodiment and the appended drawings in which.

DESCRIPTION OF THE PREFERRED EMBODIMENT

Figure 1:
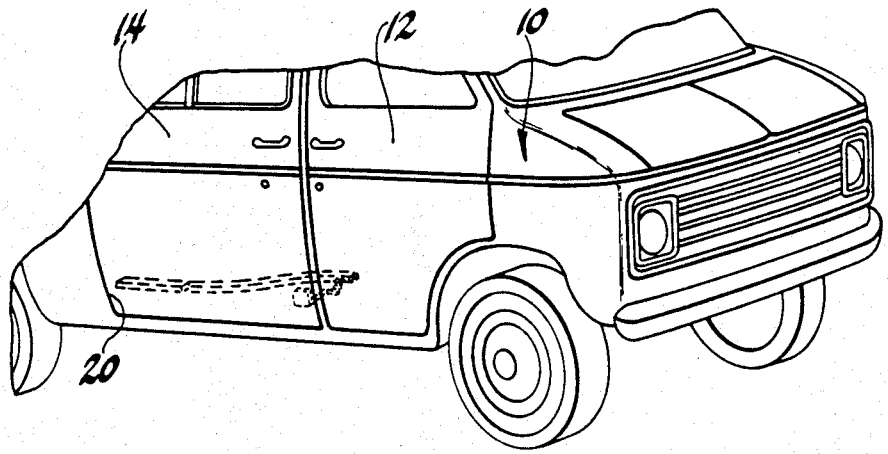
FIG. 1 is a partial perspective view of a vehicle body having a sliding door.

Referring to FIG. 1, it is seen that a van type motor vehicle generally indicated at 10 has a conventional front door 12 which is pivotally mounted for movement between open and closed positions and a rear door 14 which is slidably mounted for fore and aft movement.

Figure 2:
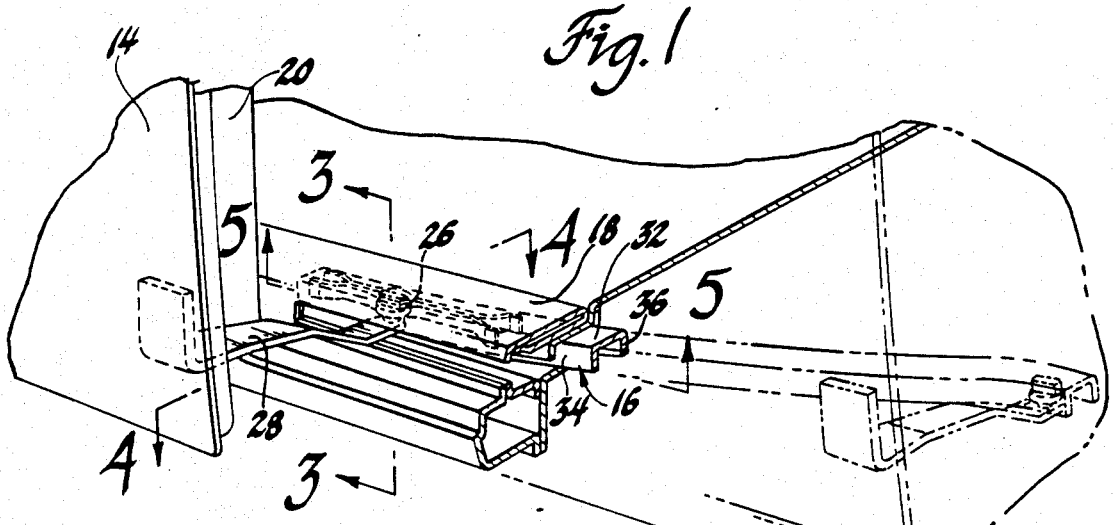
FIG. 2 is an enlarged fragmentary view similar to FIG. 1 but showing the door partly open and having parts cut away and in section to show the door mounted roller engaging a body mounted track.
Figure 3:
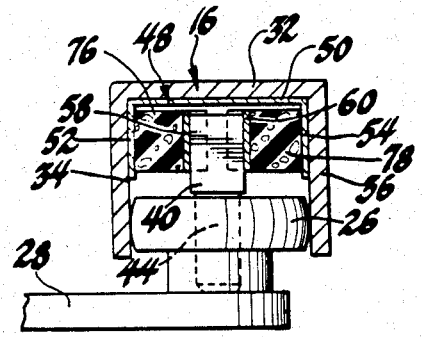
FIG. 3 is a sectional view taken in the direction of arrows 3—3 of FIG. 2.
Figure 4:
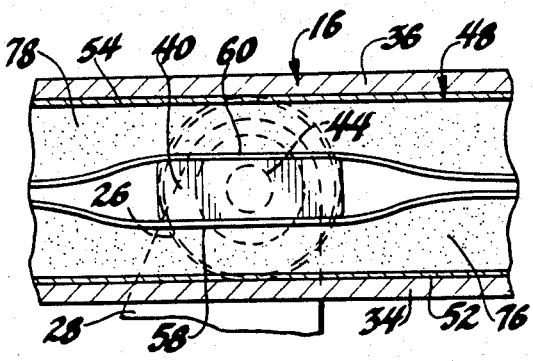
FIG. 4 is a sectional view taken in the direction of arrows 4—4 of FIG. 2.
Figure 5:
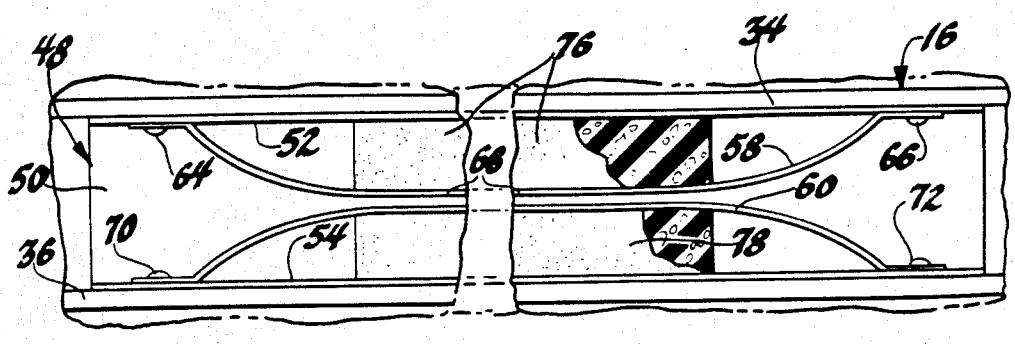
FIG. 5 is a sectional view taken in the direction of arrows 5—5 of FIG. 2.

As best seen in FIG. 2, the vehicle body mounts a channel shaped track 16 which extends longitudinally of the vehicle and is mounted beneath the floor 18 just inside the door opening 20. The sliding door 14 carries a roller 26 which is attached thereto by a mounting arm 28 and extends inside the track 16. Referring to FIGS. 3, 4 and 5, it is seen that the track 16 has a generally C-shape including a base wall 32 and side walls 34 and 36. The roller 26 is closely captured between the side walls 34 and 36 and is spaced from the base wall 32. The roller 26 is mounted on the arm 28 by a pin 44 which has an integrally extending follower member 40 which extends into proximity with the base wall 32. As seen in FIG. 2, the forwardmost end of the track 16 curves inwardly toward the center line of the vehicle so that the door 14 will glide laterally inward to a flush position with the exterior of the vehicle body as it approaches its fully closed position. Another roller, not shown, is also preferably mounted on the arm 28 and oriented to support the door vertically.

A door check and control mechanism is mounted inside the track 16 and includes a stamped metal housing 48 which is also C-shaped and includes a base wall 50 and side walls 52 and 54 which closely fit the corresponding base wall 32 and side walls 34 and 36 of the track 16. Attached to the housing 48 are a pair of resilient spring-like leaves 58 and 60. As best seen in FIG. 5, the leaf 58 is a thin strip of spring steel which extends longitudinally of the housing 48 and has its ends attached to the side wall 52 thereof by rivets 64 and 66. The leaf 58 is bowed inwardly toward the center of the housing 48 so that it presents a cam-like configuration at each end and a more linear central portion 68 at its center. The leaf 60 is similarly shaped and is attached to the side wall 54 by rivets 70 and 72.

A block of elastic material 76, such as foam rubber, is mounted in the housing 48 between the housing side wall 52 and the leaf 58. A similar elastic block 78 is mounted between the housing side wall 54 and the leaf 60.

As best seen in FIG. 4, the back and forth travel of the door between the open and closed position causes the follower member 40 attached to the door to pass between the leaves 58 and 60. This passage of the follower member 40 causes the leaves 58 and 60 to be yielded toward the side walls and to compress the elastic blocks 76 and 78. Accordingly, it will be appreciated that the back and forth movement of the door will be impeded by a combination of the frictional engagement of the follower member 40 with the leaves 58 and 60, by the flexure of the leaves 58 and 60, and by the compression of the elastic block 76 and 78.

It will be appreciated that the cam-like end portions of the leaves 58 and 60 provide a smooth transition of the follower member into the space between the leaves 76 and 78.

The aforedescribed door check and control mechanism may be tuned to provide the desired degree of control over the sliding movement of the door. For example, the length of the door check and control can be varied to provide control over a greater or lesser portion of the fore and aft travel of the door. Furthermore, the stiffness of the leaves 58 and 60 can be varied as well as varying the density and elasticity of the elastic blocks 76 and 78. In addition, it will be appreciated that the elastic blocks 76 and 78 can have a variable density or thickness over the length thereof so that varying degrees of impedance to movement of the cam follower between the leaves will be provided at different points along the path of travel of the cam follower between the leaves. In this manner, the check and control mechanism can be designed to so substantially impede movement of the door as to hold the door in either a fully open or a partly open position.

Thus, it is seen that the invention provides a new and improved door check and hold open mechanism. Although the preferred embodiment of the invention shows the cam follower as integral with the shaft mounting the roller, it will be understood that the cam follower could be a separate element carried by the mounting arm 28. Furthermore, although the drawings show a pair of leaves 58 and 60 mounted on both sides of the follower 40, it is within the scope of the invention to employ a leaf and elastic block on only one side of the follower member or to provide the leaf on the base wall of the channel so that the leaf would engage with the end face of the follower member.

It will also be understood that although the invention shows the check and control mechanism associated with the lower roller mounting of the door on the track, there is also an upper track and roller mounting between the door and the body which could alternatively house the check and control mechanism of this invention.

The embodiments of the invention in which an exclusive property or privilege is claimed are defined as follows:

1. In combination with a vehicle sliding door supported and guided by a channel shaped track mounted on the vehicle body and a roller mounted on the door and movable back and forth within the track to open and close the door, a door check and control mechanism comprising:

a follower member mounted on the door adjacent the roller and extending into the track beyond the roller and having a path of travel along the track during back and forth movement of the door, a spring-like leaf mounted within the track along at least a portion of the path of travel of the follower member, said leaf being spaced from the track at least along a portion of the length thereof and projecting into the path of travel of the follower member to interfere therewith so that the leaf is flexed and thereby impedes the travel of the door along the track, and a block of elastic material mounted in the space between the track and the leaf to yieldably support the leaf against said flexure by the follower member during back and forth movement of the door to an extent determined by the elasticity of the block of elastic material.

2. In combination with a vehicle sliding door supported and guided by a channel shaped track mounted on the vehicle body and a roller mounted on the door and movable back and forth within the track to open and close the door, a door check and control mechanism comprising:

a pin mounted on the door for mounting the roller and having an integral follower portion extending into the track beyond the roller and having a path of travel along the track during back and forth movement of the door, a spring-like leaf mounted within the track along at least a portion of the path of travel of the follower member, said leaf being spaced from the track at least along a portion of the length thereof and projecting into the path of travel of the follower member to frictionally interfere therewith so that the leaf is flexed and thereby frictionally impedes the travel of the door along the track, and a block of elastic material mounted in the space between the track and the leaf to yieldably support the leaf against said flexure by the follower member during back and forth movement of the door to an extent determined by the elasticity of the block of elastic material.

3. In combination with a vehicle sliding door supported and guided by a channel shaped track mounted on the vehicle body and a roller mounted on the door and movable back and forth within the track to open and close the door, a door check and control mechanism comprising:

a follower member mounted on the door adjacent the roller and extending into the track beyond the roller and having a path of travel along the track during back and forth movement of the door, first and second spring-like leaves mounted within the track at opposite sides of the path of travel of the follower member along the track, said leaves being spaced from the track at least along a portion of the length thereof and projecting into the path of travel of the follower member to interfere therewith so that the leaves are flexed and thereby impede the travel of the door along the track, and first and second blocks of elastic material mounted respectively in the spaces between the track and the first and second leaves to yieldably support the leaves against said flexure by the follower member during back and forth movement of the door to an extent determined by the flexibility of the leaves and the elasticity of the blocks of elastic material.

4. In a vehicle sliding door arrangement in which a door mounted roller is captured in a channel shaped track mounted on the vehicle body to support and guide the door for back and forth travel between open and closed positions, means adapted to check and control movement of the door comprising:

a follower member mounted on the door adjacent the roller and extending into the track beyond the roller and having a path of travel along the track during back and forth movement of the door; and a control mechanism adapted for mounting inside the track and having a channel shaped housing receiving the follower member therein during back and forth movement of the door, a spring-like leaf mounted within the track along at least a portion of the path of travel of the follower member, said leaf being spaced from the housing at least along a portion of the length thereof and projecting into the path of travel of the follower member to interfere therewith so that the leaf is flexed and thereby impedes the travel of the door along the track, and a block of elastic material mounted in the space between the housing and the leaf to yieldably support the leaf against said flexure by the follower member during back and forth movement of the door to an extent determined by the elasticity of the block of elastic material.

* * * * *